US012534839B2

(12) United States Patent
Phelps et al.

(10) Patent No.: US 12,534,839 B2
(45) Date of Patent: Jan. 27, 2026

(54) WASHING MACHINE APPLIANCE NON-SHEDDING LOAD DETECTION

(71) Applicant: Haier US Appliance Solutions, Inc., Wilmington, DE (US)

(72) Inventors: Stannard Nathan Phelps, Louisville, KY (US); Stephen Edward Hettinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 54 days.

(21) Appl. No.: 18/530,976

(22) Filed: Dec. 6, 2023

(65) Prior Publication Data

US 2025/0188663 A1 Jun. 12, 2025

(51) Int. Cl.

| | |
|---|---|
| ***D06F 33/48*** | (2020.01) |
| ***D06F 23/04*** | (2006.01) |
| ***D06F 33/40*** | (2020.01) |
| ***D06F 34/18*** | (2020.01) |
| ***D06F 103/06*** | (2020.01) |
| ***D06F 103/46*** | (2020.01) |
| ***D06F 105/48*** | (2020.01) |
| ***D06F 105/52*** | (2020.01) |

(52) U.S. Cl.

CPC ..... *D06F 33/48* (2020.02); *D06F 23/04* (2013.01); *D06F 33/40* (2020.02); *D06F 34/18* (2020.02); *D06F 2103/06* (2020.02); *D06F 2103/46* (2020.02); *D06F 2105/48* (2020.02); *D06F 2105/52* (2020.02)

(58) Field of Classification Search

None

See application file for complete search history.

(56) References Cited

U.S. PATENT DOCUMENTS

| | | | |
|---|---|---|---|
| 7,958,585 | B2 | 6/2011 | Zhang et al. |
| 8,042,211 | B2 | 10/2011 | Stansel et al. |
| 8,813,288 | B2 | 8/2014 | Bhandwale et al. |
| 8,932,369 | B2 | 1/2015 | Miller et al. |
| 9,096,964 | B2 | 8/2015 | Albayrak et al. |
| 9,200,401 | B2 | 12/2015 | Chung et al. |
| 9,371,607 | B2 | 6/2016 | Pascualena et al. |
| 9,863,080 | B2 | 1/2018 | Fugal et al. |
| 9,890,490 | B2 | 2/2018 | Janke et al. |

(Continued)

FOREIGN PATENT DOCUMENTS

| | | | |
|---|---|---|---|
| WO | WO2014191248 | A1 | 12/2014 |
| WO | WO2020050621 | A1 | 3/2020 |

*Primary Examiner* — Rita P Adhlakha

(74) *Attorney, Agent, or Firm* — Dority & Manning, P.A.

(57) ABSTRACT

A washing machine appliance includes a tub and a rotatable basket therein. A method of operating the washing machine appliance may include rotating the basket at one or more first speeds prior to a water extraction operation and obtaining a first set of power measurements. The method may also include performing the water extraction operation. The water extraction operation may include rotating the basket at a second speed greater than the one or more first speeds. The method may further include rotating the basket at the one or more first speeds after the water extraction operation and obtaining a second set of power measurements. The method may also include determining a load type of the load of articles based on the first set of power measurements and the second set of power measurements.

20 Claims, 4 Drawing Sheets

(56) References Cited

U.S. PATENT DOCUMENTS

| | | | | |
|---|---|---|---|---|
| 10,041,202 | B2 | 8/2018 | Sumer et al. | |
| 10,047,470 | B2 | 8/2018 | Kim et al. | |
| 10,301,762 | B2 | 5/2019 | Sumer et al. | |
| 2008/0178398 | A1 | 7/2008 | Darby et al. | |
| 2024/0141574 | A1* | 5/2024 | Smith | D06F 33/40 |

* cited by examiner

WASHING MACHINE APPLIANCE NON-SHEDDING LOAD DETECTION

FIELD

The present subject matter relates generally to washing machine appliances and methods for operating washing machine appliances, and more particularly to systems and methods for detecting a non-shedding load of articles in such appliances.

BACKGROUND

Washing machine appliances generally include a tub for containing washing fluid, e.g., water, detergent, and/or bleach, during operation of such washing machine appliances. A basket is rotatably mounted within the tub and defines a wash chamber for receipt of articles for washing. During operation of such washing machine appliances, washing fluid is directed into the tub and onto articles within the wash chamber of the basket. The basket can rotate at various speeds to agitate articles within the wash chamber in the washing fluid, to wring washing fluid from articles within the wash chamber, etc. Washing machine appliances include vertical axis washing machine appliances and horizontal axis washing machine appliances, where "vertical axis" and "horizontal axis" refer to the axis of rotation of the wash basket within the wash tub.

A concern during operation of washing machine appliances is the distribution of the mass of the contents, e.g., a load of articles and wash liquid, on the balance of the basket. For example, the articles and wash liquid within the basket may not be equally weighted about a central axis of the basket and tub. Accordingly, when the basket rotates, in particular during a spin cycle, the imbalance in mass may cause the basket to be out-of-balance within the tub, such that the axis of rotation does not align with the central axis of the basket or tub. Such out-of-balance issues during rotation of the basket can cause excessive noise, vibration or motion, or other undesired conditions.

Further, a type of the load of articles, e.g., a material type and the absorbency of the material of the articles, may influence the behavior of the wash liquid and articles during the spin cycle. In particular, when the load includes one or more non-shedding articles, e.g., articles which are waterproof or very low water absorbency, wash liquid may be retained within the basket up to a certain rotational speed (such as entrapped within folds of a non-shedding article) and then, as the rotation accelerates, the wash liquid may be rapidly displaced within or from the basket, e.g., may be suddenly released from the non-shedding article, causing a sudden shift in the center of mass of the contents of the basket. Such shifting of the center of mass may result in an increased likelihood of an out-of-balance condition. For example, in laundry appliances having a balancing system, the balancing system may not recover fast enough in response to the sudden release of wash liquid from within the non-shedding article.

Accordingly, a laundry appliance having improved features for determining whether a load of articles therein includes non-shedding articles would be desired.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a washing machine appliance is provided. The washing machine appliance includes a wash tub mounted within the washing machine appliance and a basket rotatably mounted within the wash tub. The method includes rotating the basket at one or more first speeds prior to a water extraction operation and obtaining a first set of power measurements for power drawn by a motor of the washing machine appliance while rotating the basket at the one or more first speeds prior to the water extraction operation. The method also includes performing the water extraction operation after obtaining the first set of power measurements. The water extraction operation comprises rotating the basket at a second speed greater than the one or more first speeds. The method further includes rotating the basket at the one or more first speeds after the water extraction operation and obtaining a second set of power measurements for power drawn by the motor of the washing machine appliance while rotating the basket at the one or more first speeds after the water extraction operation. The method also includes determining a load type of the load of articles based on the first set of power measurements and the second set of power measurements.

In another aspect of the present disclosure, a washing machine appliance is provided. The washing machine appliance includes a wash tub mounted within the washing machine appliance and a basket rotatably mounted within the wash tub. The washing machine appliance also includes a controller. The controller is configured for rotating the basket at one or more first speeds prior to a water extraction operation and obtaining a first set of power measurements for power drawn by a motor of the washing machine appliance while rotating the basket at the one or more first speeds prior to the water extraction operation. The controller is also configured for performing the water extraction operation after obtaining the first set of power measurements. The water extraction operation comprises rotating the basket at a second speed greater than the one or more first speeds. The controller is further configured for rotating the basket at the one or more first speeds after the water extraction operation and obtaining a second set of power measurements for power drawn by the motor of the washing machine appliance while rotating the basket at the one or more first speeds after the water extraction operation. The controller is also configured for determining a load type of the load of articles based on the first set of power measurements and the second set of power measurements.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
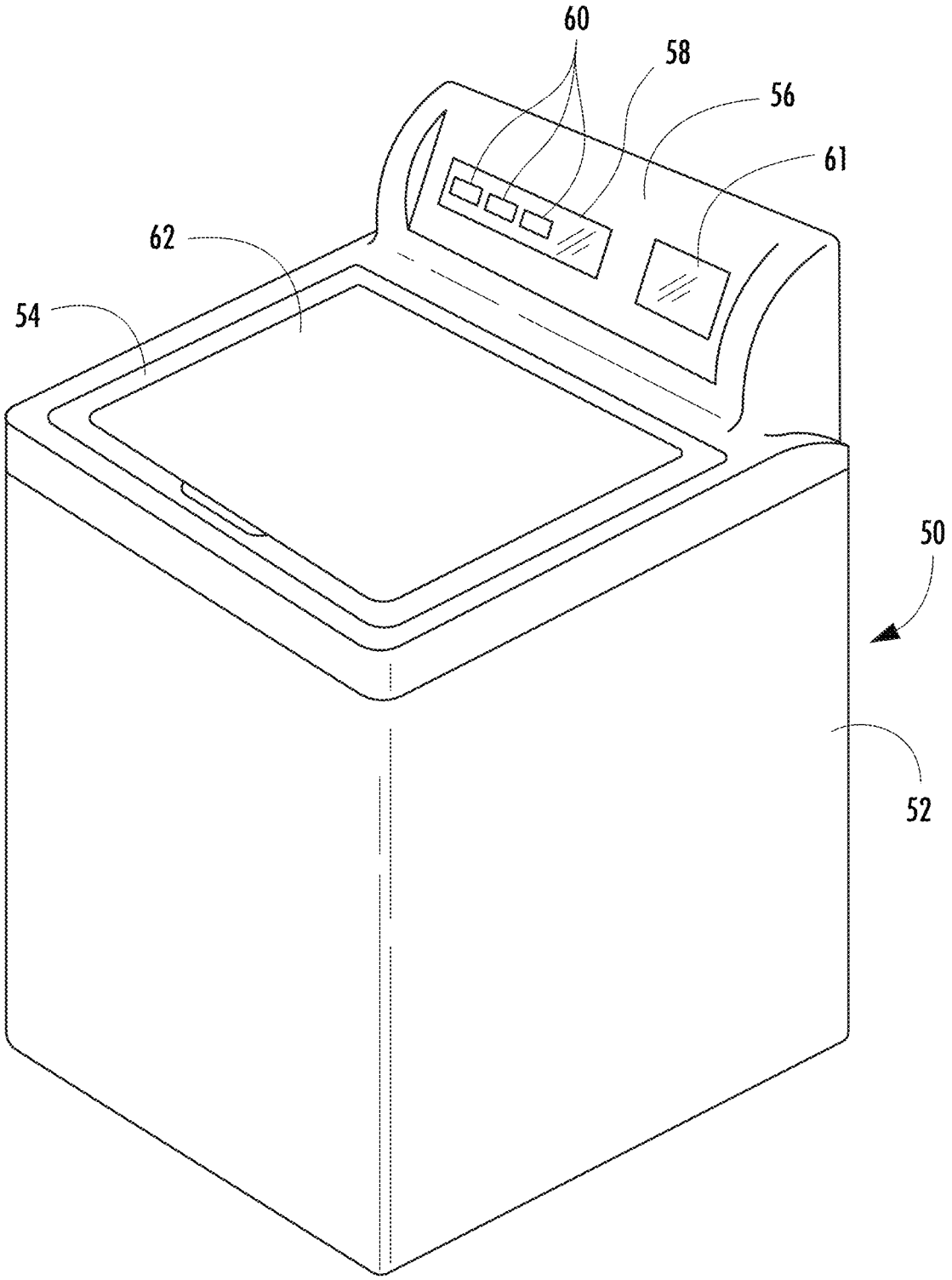
FIG. 1 provides a perspective view of a washing machine appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise. As used herein, the terms "first," "second," and "third" may be used interchangeably to distinguish one component or step from another and are not intended to signify order, location, or importance of the individual components or steps.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

FIG. 1 provides a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58, including a plurality of input selectors 60, is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 (FIG. 2) located within cabinet 52, and a closed position (shown in FIG. 1) forming an enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances.

Figure 2:
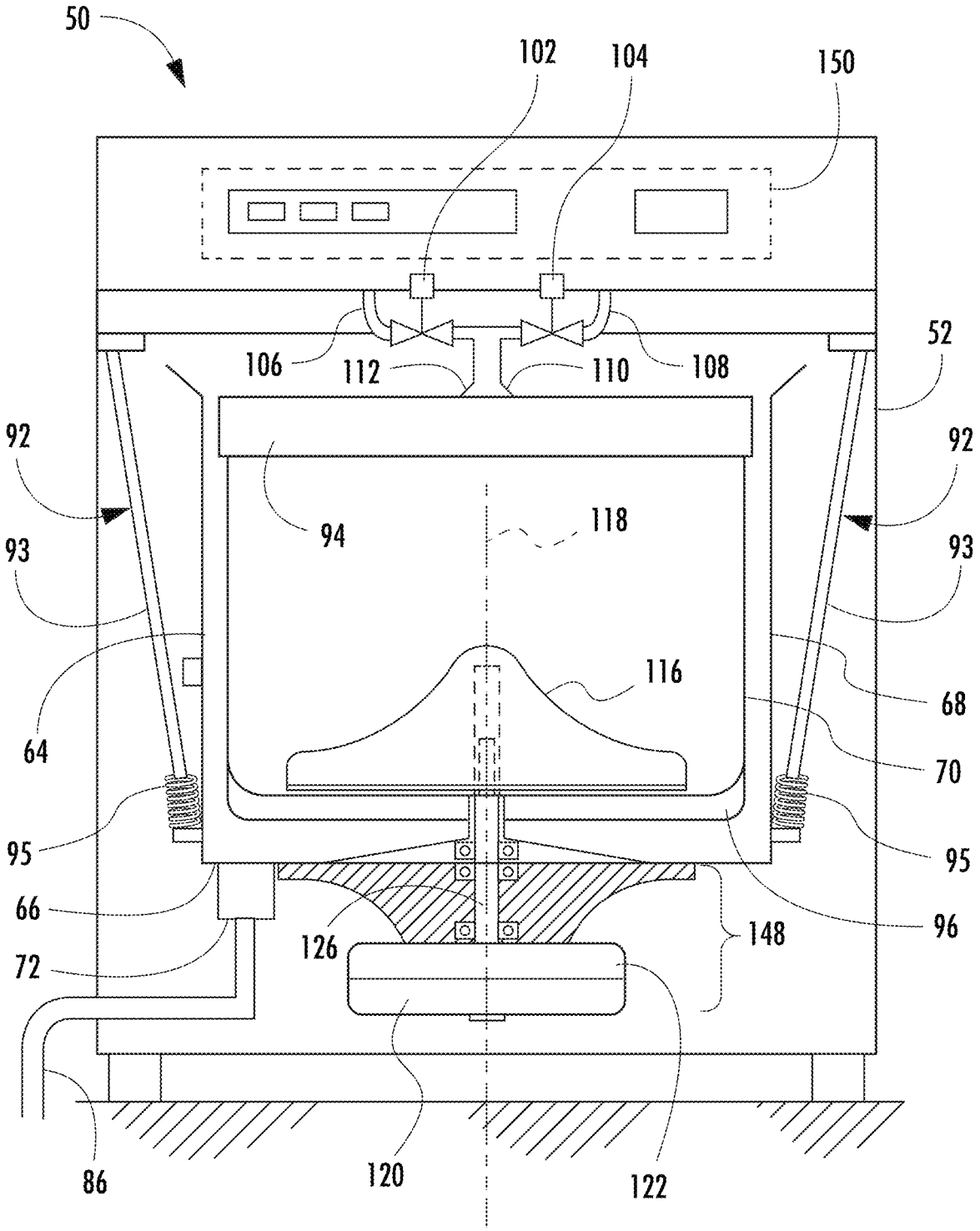
FIG. 2 provides a front, section view of the exemplary washing machine appliance of FIG. 1.

FIG. 2 provides a front elevation schematic view of certain components of an example washing machine appliance 50 including a wash tub 64 and a basket 70 rotatably mounted within wash tub 64. Wash tub 64 includes a bottom wall 66 and a sidewall 68. A pump assembly 72 is located beneath tub 64 and basket 70 for gravity assisted flow when draining tub 64. The pump assembly 72 may be coupled to the wash tub 64, e.g., at the bottom wall 66 thereof, such as directly coupled to the bottom wall 66 as illustrated in FIG. 2, or the pump assembly 72 may be coupled to the wash tub 64 via a pump inlet hose which extends from the bottom wall 66 to the pump assembly 72. A pump outlet hose 86 extends from the pump assembly 72 to a building plumbing system discharge line (not shown).

As may be seen in FIG. 2, the wash basket 70 is movably disposed and rotatably mounted in wash tub 64 in a spaced apart relationship from tub sidewall 68 and tub bottom wall 66. Basket 70 includes a plurality of perforations therein to facilitate fluid communication between an interior of basket 70 and wash tub 64.

A hot liquid valve 102 and a cold liquid valve 104 deliver liquid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and liquid is dispersed from inlet tube 110 through a nozzle assembly 112 having a number of openings therein to direct washing liquid into basket 70 at a given trajectory and velocity. A dispenser (not shown in FIG. 2) may also be provided to produce a liquid or wash solution by mixing fresh water with a detergent and/or other additive for cleansing of articles in basket 70.

Still referring to FIG. 2, an agitation element 116, such as a vane agitator, impeller, auger, or oscillatory basket mechanism, or some combination thereof, is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated, agitation element 116 is oriented to rotate about a vertical axis 118.

Basket 70 and agitation element 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred to herein as a motor assembly 148.

Basket 70, tub 64, and machine drive system 148 are supported by a vibration dampening suspension system. The dampening suspension system generally operates to dampen dynamic motion as the wash basket 70 rotates within the tub 64. The dampening suspension system can include one or more suspension assemblies 92 coupled between and to the cabinet 52 and wash tub 64. Typically, four suspension assemblies 92 are utilized, and are spaced apart about the wash tub 64. For example, each suspension assembly 92 may include a suspension rod 93 connected at one end proximate a corner of the cabinet 52 and at an opposite end to the wash tub 64. The opposite end of the suspension rod 93 connected to the wash tub 64 may be surrounded, e.g., encircled, by a suspension spring 95.

In addition to the vibration dampening suspension assemblies 92, the washer can include other vibration dampening elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

Operation of washing machine appliance 50 is controlled by a controller 150 that is operatively coupled to the user interface input located on washing machine backsplash 56 (shown in FIG. 1) for user manipulation to select washing machine cycles and features. In response to user manipulation of the user interface input, controller 150 operates the various components of washing machine appliance 50 to execute selected machine cycles and features.

Controller 150 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 (such as motor assembly 148) may be in communication with controller 150 via one or more signal lines or shared communication busses to provide signals to and/or receive signals from the controller 150.

In an illustrative embodiment, laundry items are loaded into basket 70, and washing operation is initiated through operator manipulation of control input selectors 60 (shown in FIG. 1). Tub 64 is filled with liquid such as water and mixed with detergent to form a wash fluid, and basket 70 is agitated with agitation element 116 for cleansing of laundry items in basket 70. For example, agitation element 116 may be moved back and forth in an oscillatory back and forth motion about vertical axis 118, while basket 70 remains generally stationary (i.e., not actively rotated). Such oscillatory motion may be obtained in different embodiments with a reversing motor, a reversible clutch, or other known reciprocating mechanism. After the agitation phase of the wash cycle is completed, tub 64 is drained with pump assembly 72. Laundry articles can then be rinsed by again adding liquid to tub 64. Depending on the particulars of the cleaning cycle selected by a user, agitation element 116 may again provide agitation within basket 70. After a rinse cycle, tub 64 is again drained, such as through use of pump assembly 72. After liquid is drained from tub 64, one or more spin cycles may be performed. In particular, a spin cycle may be applied after the agitation phase and/or after the rinse phase in order to wring excess wash fluid from the articles being washed. During a spin cycle, basket 70 is rotated at relatively high speeds about vertical axis 118, such as between approximately 450 and approximately 1300 revolutions per minute.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well. For example, the present subject matter may be used with a washing machine appliance having a belt and pulley drive system instead of the example transmission and clutch system.

Figure 3:
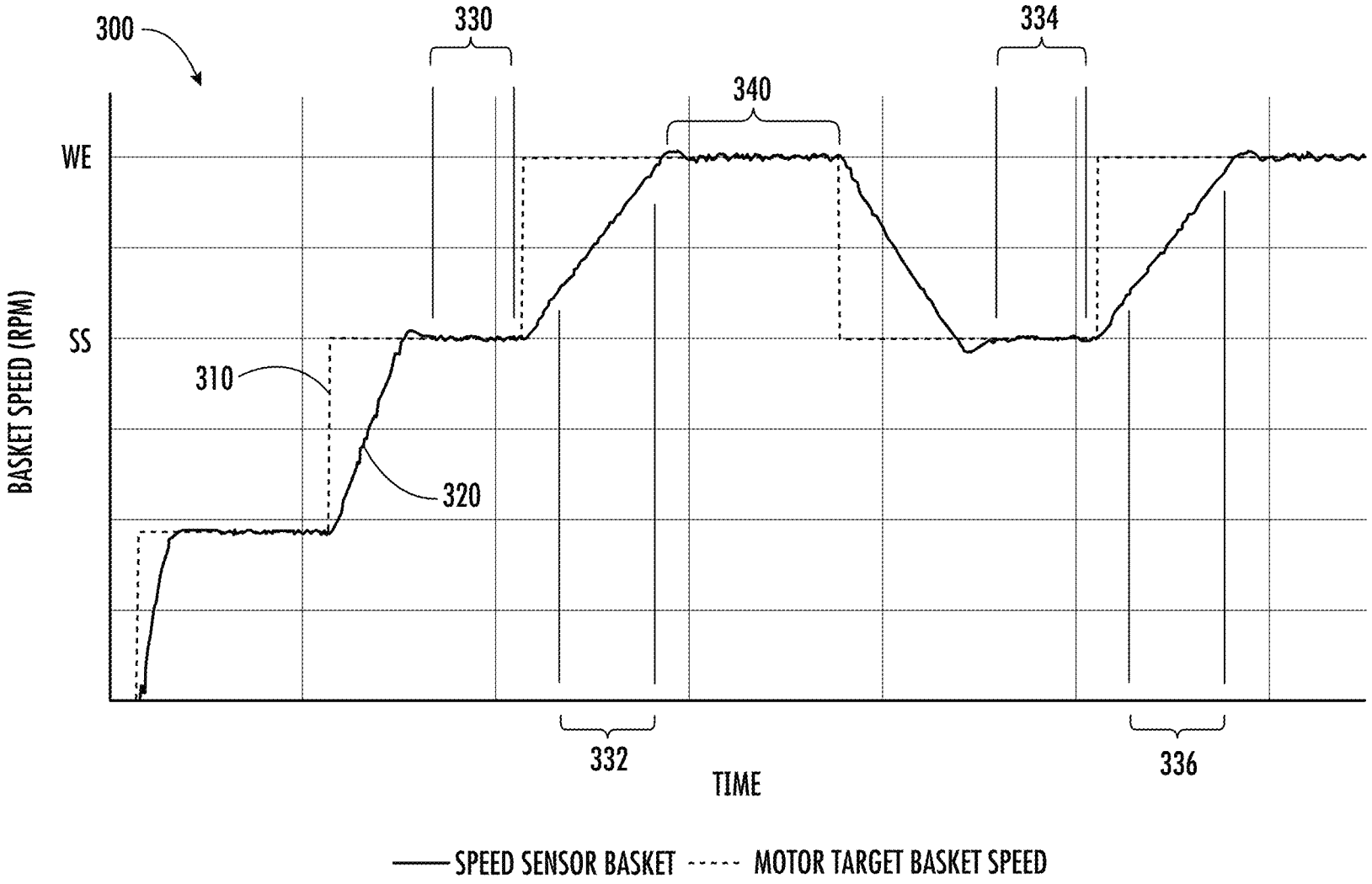
FIG. 3 provides a plot of a basket speed over time during an exemplary operation of a washing machine appliance.

Referring now to FIG. 3, an exemplary plot 300 of basket speed over time during an exemplary operation of a washing machine appliance according to one or more embodiments of the present disclosure is provided. The exemplary operation of the washing machine appliance illustrated in FIG. 3 may be a spin cycle or a part of a spin cycle, and the spin cycle itself may be part of an overall wash cycle or washing operation. The basket speed may be a rotational speed, e.g., in revolutions per minute (RPM), and the time may be on the order of minutes and seconds or hundreds of seconds. Plot 300 illustrates both an exemplary target speed (e.g., as may be set by the controller of the washing machine appliance) 310 and an exemplary measured speed 320. As is generally shown in FIG. 3, the target speed may change generally instantaneously, whereas the actual (measured) rotational speed takes longer to change, e.g., ramps up or down over a period of time to reach the adjusted target speed.

As may be seen in FIG. 3, multiple sets of power measurements may be taken during the exemplary operation of the washing machine appliance, such as during constant (steady state) rotation speed and/or during a ramp period, e.g., as indicated at 330, 332, 334, and/or 336 in FIG. 3. For example, the exemplary operation of the washing machine appliance may include a first set of steady state or dwell power measurements 330, a first set of ramp power measurements 332, a second set of dwell power measurements 334, and a second set of ramp power measurements 336. Each set of power measurements may be a series of instantaneous power measurements taken consecutively (e.g., at a regular interval) over a period of time, e.g., within the periods of time encompassed by the respective brackets at 330, 332, 334, and 336.

The exemplary operation may also include a water extraction operation 340, where the water extraction operation 340 may include rotating the basket at a high speed to extract moisture from articles in the basket, e.g., by centrifugal force, as is generally understood by those of skill in the laundry art.

As may be seen in FIG. 3, the water extraction operation 340 may include rotating the basket at a relatively high speed, which is higher than speeds at which the basket may be rotated during wash and/or rinse sub-cycles. The relatively high speed during water extraction operation 340 is thus understood as being "high speed" in comparison to other portions or sub-cycles of the operation. For example, the relatively high speed may be between about 300 RPM and about 600 RPM, such as between about 350 RPM and about 550 RPM, such as about 450 RPM, among other possible high speeds, including multiple distinct high speeds within a single water extraction operation, which may be included in the water extraction operation 340 and/or a terminal spin.

In some cases, a terminal spin may also be performed after the water extraction operation and at a higher speed than the water extraction operation, however, in other examples, e.g., when the load is a non-shedding load, the terminal spin may be omitted or may performed at a reduced speed less than a maximum extraction speed and/or less than the speed of the water extraction operation. For example, the terminal spin may be performed (if at all) at a maximum extraction speed which may be greater than the water extraction operation 340 speed, such as the speed during water extraction operation 340 may be less than the maximum extraction speed in order to avoid or reduce the chance of entrapped liquid (if any, such as if the load is a non-shedding load) becoming dislodged during water extraction operation 340. In embodiments where the terminal spin is performed at maximum extraction speed, the maximum extraction speed may be greater than the speed from operation 340, such as about 600 RPM or greater, such as between about 600 RPM and about 1300 RPM, such as between about 700 RPM and about 1000 RPM, such as about 800 RPM.

Embodiments of the present disclosure may include detecting and/or verifying entrapped wash liquid, e.g., a non-shedding load of articles in the basket, which may be determined using a Non-Shedding Load (NSL) score, as will be described further below. Such embodiments may further include one or more remedial actions to limit the effects of the non-shedding load, such as performing a load redistribution operation to try to disgorge entrapped wash liquid from the non-shedding load, and/or limiting a final spin speed, e.g., not spinning the basket up to the maximum extraction speed, when the load of articles in the basket is a non-shedding load type. Thus, the terminal spin may be an optional portion of the exemplary wash operation which may be omitted or performed at a lower speed (less than maximum extraction speed). The load redistribution operation may include rotating the basket and/or an agitator therein, such as oscillating one or both of the basket and agitator back and forth, at a tumble speed (e.g., less than water extraction speed and/or less than a plaster speed, as will be understood by those of ordinary skill in the art), and may also include draining the wash tub and re-filling the wash tub with a second volume of water. For example, the load redistribution operation may free any water trapped in the folds of the non-shedding articles and promote balancing the load.

As may be seen in FIG. 3, the washer basket spins up to a Steady State (SS) speed. The SS speed is below both the terminal spin speed and the next measurement speeds. A first power measurement or first set of power measurements may be taken while maintaining the SS speed. For example, as shown in FIG. 3, the first set of dwell power measurements 330 may be obtained beginning at a time when the measured speed 320 reaches the SS speed. In some embodiments where a single first dwell measurement is taken, the single measurement may be obtained at any point within the range encompassed by the bracket at 330 in FIG. 3.

The basket then accelerates to a higher Water Extraction (WE) speed. A first acceleration power measurement or first set of acceleration power measurements may be recorded during the acceleration of the basket up to WE speed. For example, the first set of ramp power measurements 332 may be obtained while accelerating from SS speed to WE speed. As may be seen in FIG. 3, the first and second ramp power measurements 332 and 336 may be obtained over less than all of the ramp period, such as over an intermediate portion of the ramp period, such as starting at a speed greater than the SS speed and ending when the basket is at a speed less than the WE speed. Once the WE speed is reached, the spin speed of the basket is maintained for some time (e.g., across the time span encompassed by the bracket at 340 in FIG. 3) to remove water from the load (WE speed is below terminal speed but above power measurement speeds).

Once the water extraction operation 340 is completed, the basket speed is then allowed to decrease back down (e.g., decelerate or ramp down) to the initial measurement speed, e.g., SS speed as noted in FIG. 3. A second steady state power measurement or a second set of steady state power measurements may then be taken while maintaining the basket at SS speed. For example, the second set of dwell power measurements 334 may be obtained while rotating the basket at SS speed after the water extraction operation 340. The washer basket then accelerates back up to the WE speed. A second acceleration power measurement or second set of acceleration power measurements may be recorded during this acceleration. For example, the second set of ramp power measurements 336 may be obtained during an intermediate portion of the ramp period between the SS speed and the WE speed after the second set of dwell power measurements 334 is taken.

The power measurements may be used to determine a load type of the load of articles in the basket. For example, the load type of the load of articles may be determined based on a load score such as a Non-Shedding Load (NSL) score, e.g., which is generally based on a comparison, e.g., a mathematical comparison, of one or more power measurements obtained prior to the water extraction operation with one or more power measurements obtained after the water extraction operation. Thus, the one or more power measurements prior to the water extraction operation may relate to a wet or saturated mass or inertia of the load of articles in the basket. The one or more power measurements after to the water extraction operation (at which point the load of articles is expected to be drier, e.g., to have a significantly lower remaining moisture content than at the time when the wet inertia was measured) may relate to a dry mass or inertia of the load of articles. Thus, when the dry inertia is close to the wet inertia, e.g., as reflected by the respective power measurements being close or similar to each other when compared, then it may thereby be determined that the load of articles is a non-shedding load, e.g., that water may be entrapped within the load of articles. Accordingly, the NSL Score based on the comparison of the pre-extraction power measurement(s) with the post-extraction power measurement(s) may be used to determine whether the load is a non-shedding load.

In some embodiments, the average and standard deviation of each set of power measurements may be taken, e.g., from the series or collection of instantaneous measurements. For example, the standard deviations may reduce or remove the influence of transient conditions, e.g., an out-of-balance condition, changes in system friction as the unit heats up, and/or other transient conditions, which may occur while the sets of power measurements are being obtained. In some embodiments, the standard deviations of the power measurement sets could be a range or another similar value that represents similar details. Accordingly, the following variables may be calculated: SSPM1_Avg (average of the first set of dwell power measurements 330), SSPM1_STDV (standard deviation of the first set of dwell power measurements 330), SSPM2_Avg (average of the second set of dwell power measurements 334), SSPM2_STDV (standard deviation of the second set of dwell power measurements 334), APM1_Avg (average of the first set of ramp power measurements 332), APM1_STDV (standard deviation of the first set of ramp power measurements 332), APM2_Avg (average of the second set of ramp power measurements 336), APM2_STDV (standard deviation of the second set of ramp power measurements 336). Using the foregoing values, an NSL score may be calculated and the calculated value of the NSL score may be used to determine a load type of the load of articles in the basket, e.g., whether the load is a shedding load or a non-shedding load.

In some embodiments, the NSL score may be based in part on a System Friction Proxy (SFP). For example, the SFP may be calculated using the sets of power measurements and the variables enumerated above, such as using the following equation:

$$SFP = \text{AVERAGE (SSPM1_Avg, SSPM2_Avg)} - \text{AVERAGE (SSPM1_STDV, SSPM2_STDV)}.$$

That is, the System Friction Proxy may be based on an average of the averages of the first and second sets of dwell power measurements minus an average of the standard deviations of the first and second sets of dwell power measurements. As another example, in some embodiments, the SFP may further be based on a scaling factor, N, e.g., as in the following equation:

$$SFP = \text{AVERAGE (SSPM1_Avg, SSPM2_Avg)} - \text{AVERAGE (SSPM1_STDV, SSPM2_STDV)} * N.$$

For example, the scaling factor N may have a value between zero and ten (including a value of one, in which case the N value would factor out of the SFP calculation, e.g., the scaling factor N is optional). In some cases, the scaling factor N may help to discern shedding and non-shedding load types. In various embodiments, the scaling factor N may be applied to the minuend or the subtrahend of the above equation. For example, the scaling factor N may be applied such that the likelihood of obtaining a negative number value for the SFP is avoided or reduced.

The acceleration power measurements and the System Friction Proxy (SFP) may be used to determine the load type, e.g., to calculate an NSL score. For example, the NSL score may be calculated from the following equation:

$$NSL \text{ score} = \left[(\text{APM2_Avg} - SFP)/(\text{APM1_Avg} - SFP)\right] - 1.$$

When calculated using the above equation, the higher the NSL score, the more likely the load is a non-shedding load, while the lower the NSL score is, the less likely the load is a non-shedding load. In additional embodiments, the NSL score may be calculated using a fraction that is the inverse of the fraction in the above equation, in which case a lower NSL score is more likely to be a non-shedding load. Additional alternative forms for the NSL score may be provided, such as the subtraction of one may be removed (e.g., the NSL score may be determined from the fraction alone), or the difference between average power measurements may be used instead of a ratio. As another example, the system friction may be removed from the NSL score equation, e.g., the NSL score may be calculated without the SFP. In further embodiments, the ramp and dwell differences may be accounted for in the same equation, such as in the following equation:

$$NSL \text{ score} = \left[(\text{APM2_Avg} + \text{SSPM2_Avg})/(\text{APM1_Avg} + \text{SSPM1_Avg})\right] - 1.$$

In some embodiments, the dwell power may be considered on its own, such as the NSL score may be calculated from the following equation:

$$NSL \text{ score} = (\text{SSPM2_Avg}/\text{SSPM1_Avg}) - 1.$$

In some embodiments, the dwell power may be considered with system friction, such as the NSL score may be calculated from the following equation:

$$NSL \text{ score} = \left[(\text{SSPM2_Avg} - SFP)/(\text{SSPM1_Avg} - SFP)\right] - 1.$$

Additionally, as noted above, one or more remedial actions may also be performed when a non-shedding load type is detected, such as when the NSL score indicates a non-shedding load. For example, a load redistribution operation may be performed to attempt to dislodge entrapped wash liquid from the non-shedding load, the terminal spin speed may be reduced or eliminated, etc.

It should be understood that the foregoing examples are provided by way of illustration only and are not limiting. In additional embodiments, any number or combination of power measurements may be collected over any spin speed ranges, such as the SS speed at which the first and second dwell measurements are taken could be any speed greater than about zero RPM, up to just below the WE speed. In further embodiments, electrical current measurements may be used instead of power measurements. Some embodiments may include calculating multiple NSL scores, e.g., at different steps of the spin segments and/or with different thresholds. As a further example, the measurements can be adjusted by any factors, such as the scaling factor N, or other factors in addition to or instead of the scaling factor N, e.g., a multiplier ratio or a ratio of the number of actual measurement samples to an expected number of samples. In additional embodiments, the measurements, e.g., power measurements, may be obtained at a variety of frequencies over a variety of time periods and RPM ranges.

Figure 4:
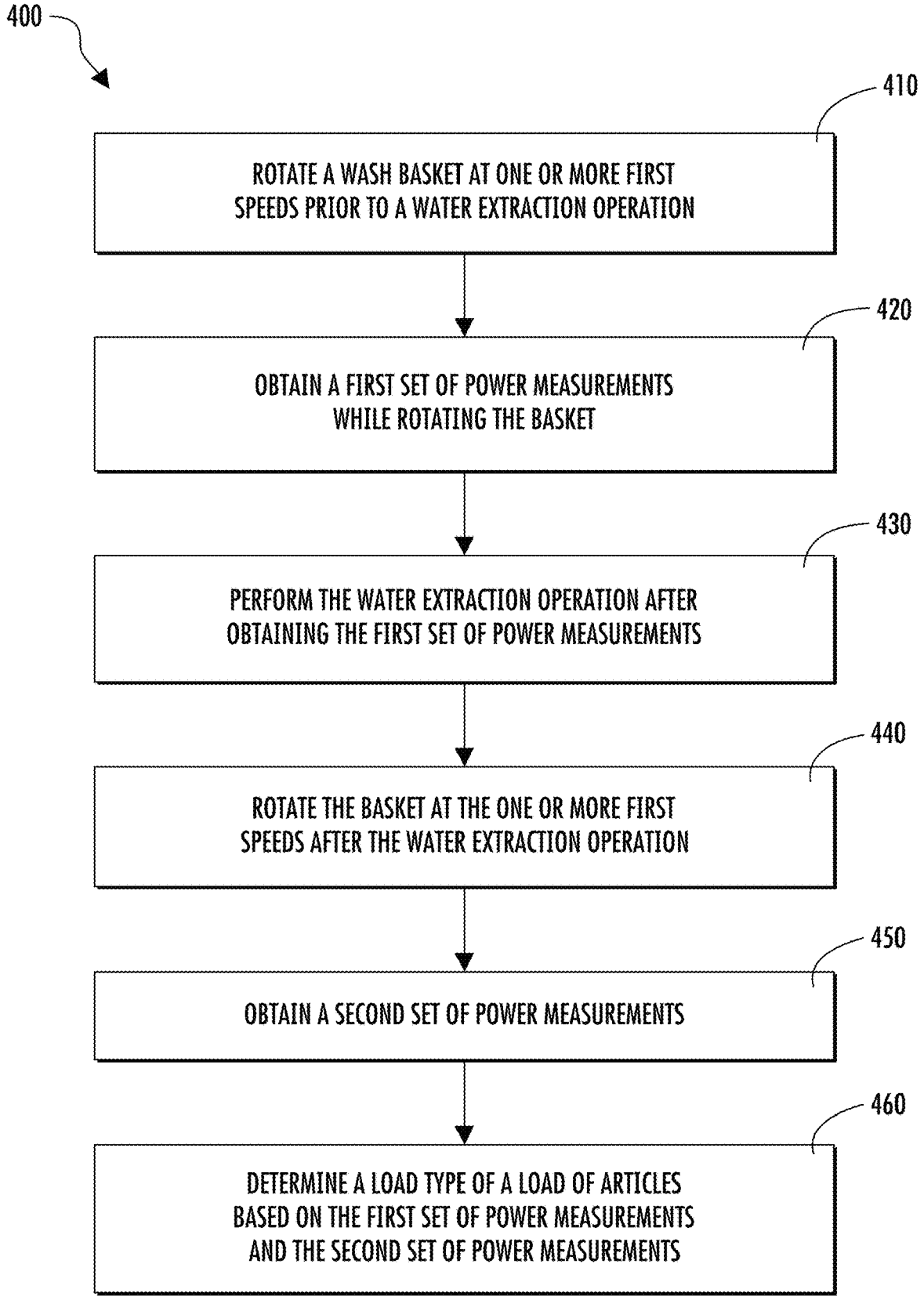
FIG. 4 provides a flow chart illustrating an exemplary method for operating a washing machine appliance in accordance with one or more additional exemplary embodiments of the present disclosure.

Turning now to FIG. 4, embodiments of the present disclosure may also include methods of operating a washing machine appliance, such as the example method 400 illustrated in FIG. 4. Such methods may be used with any suitable washing machine appliance, such as washing machine appliance 50, as described above. For example, as mentioned above, the washing machine appliance 50 may include a controller 150 and the controller 150 may be operable for, e.g., configured for, performing some or all of the methods and/or steps thereof described herein. For example, one or more method steps may be embodied as an algorithm or program stored in a memory of the controller 150 and executed by the controller 150 in response to a user input such as a selection of a wash operation or rinse and spin operation, etc., of the washing machine appliance 50.

Method 400 may include initiating a wash cycle of the washing machine appliance, e.g., in response to a user input received from a user interface of the washing machine appliance, wherein the controller 150 receives a signal, via a wired or wireless connection, from the user interface and initiates the wash cycle in response to the signal. Method 400 may further include one or more wash and/or rinse sub-cycles, e.g., segments of the wash cycle which was initiated. After the one or more wash and/or rinse sub-cycles, method 400 may proceed to draining the wash liquid from the tub, and preparing for a spin cycle. The spin cycle may include rotating the basket at varying speeds, and may include determining a load type of the load of articles, such as determining whether the load of articles is a shedding load type or a non-shedding load type. Thus, for example, the specific processes illustrated in FIG. 4 may be performed during a spin cycle of a washing operation.

In some embodiments, method 400 may include (410) rotating the basket at one or more first speeds prior to a water extraction operation. In some embodiments, the one or more first speeds may be a single one first speed, e.g., a steady state speed wherein the basket is rotated at or about the one single speed throughout (410), such the basket may be rotated at or about the one single speed while obtaining a first set of power measurements. In other embodiments, the one or more first speeds may be more than one speed, e.g., a range of speeds, such as a range of speeds during a portion of a ramp period in which the basket speed is ramping up or ramping down.

Method 400 may further include (420) obtaining a first set of power measurements for power drawn by a motor of the washing machine appliance while rotating the basket at the one or more first speeds prior to the water extraction operation. Those of ordinary skill in the art will recognize that the power drawn by the motor may be generally proportional to the mass or inertia of the load of articles. In particular, when the power is measured before the water extraction operation, the power drawn by the motor in order to rotate the basket may correspond to the mass of the load of articles plus a volume or amount of liquid absorbed in the articles or otherwise retained within the basket with the articles, e.g., a wet mass or wet inertia.

Method 400 may also include (430) performing the water extraction operation, e.g., such as the water extraction operation 340 described above or other similar operations wherein the basket is rotated at speeds less than the final terminal speed (e.g., less than maximum extraction speed) but fast enough to wring moisture from the articles and/or to centrifugally extract moisture from the basket and/or from articles therein. The basket may be rotated at relatively low speeds (e.g., as compared to maximum extraction speed) during process (430) to avoid or reduce the chance of entrapped liquid becoming dislodged during such water extraction, e.g., in case the load is a non-shedding load.

After the water extraction operation at (430), the basket may then be decelerated. For example, method 400 may include (440) rotating the basket at the one or more first speeds after the water extraction operation. Thus, in various embodiments, method 400 may include decelerating the basket, followed by rotating the basket again at the one single first speed or through the first range of speeds. While again rotating the basket at the one or more first speeds, a second set of power measurements may be obtained. For example, as illustrated in FIG. 4, method 400 may include (450) obtaining a second set of power measurements for power drawn by the motor of the washing machine appliance while rotating the basket at the one or more first speeds after the water extraction operation. Each set of power measurements, e.g., the first and second sets as well as any other sets which may be obtained in various embodiments, may be a series of instantaneous power measurements taken consecutively over a period of time.

Also as may be seen in FIG. 4, method 400 may further include (460) determining a load type of a load of articles based on the first set of power measurements and the second set of power measurements. For example, determining the load type of the load of articles may include determining, e.g., calculating, an NSL score for the load of articles and determining the load type based on the NSL score, such as determining the load of articles is a non-shedding load based on the NSL score above or below (or equal to) a predetermined threshold. The NSL score may be calculated from one or more sets of power measurements, such as according to any of the exemplary equations and other examples discussed above.

As mentioned above, in some embodiments, the one or more first speeds may be a steady state speed (e.g., at or about one single speed). In such embodiments, the first set of power measurements may be a first set of dwell power measurements and the second set of power measurements may be a second set of dwell power measurements. Also in such embodiments, method 400 may further include obtaining a first set of ramp power measurements while accelerating the basket from the steady state speed to the second speed prior to the water extraction operation, and obtaining a second set of ramp power measurements while accelerating the basket from the steady state speed to the second speed after obtaining the second set of dwell power measurements. The second speed may be, for example, the water extraction speed, or may be greater than the water extraction speed, or may be less than the water extraction speed and greater than the first speed.

As mentioned above, in some embodiments, the one or more first speeds may include accelerating (ramping up) the basket from a steady state speed to the second speed (the second speed may be, e.g., the water extraction speed, or may be different from the water extraction speed). In such embodiments, the first set of power measurements may be a first set of ramp power measurements and the second set of power measurements may be a second set of ramp power measurements. Such methods may further include obtaining a first set of dwell power measurements while rotating the basket at the steady state speed prior to obtaining the first set of ramp power measurements and obtaining a second set of dwell power measurements while rotating the basket at the steady state speed after the water extraction operation and prior to obtaining the second set of ramp power measurements.

In some embodiments, method 400 may also include calculating a representative value of the first set of power measurements and calculating a representative value of the second set of power measurements. In such embodiments, the load type of the load of articles may be determined based on the representative value of the first set of power measurements and the representative value of the second set of power measurements, such as an NSL score may be calculated using the representative values of the sets of power measurements. The representative value may be, for example, an average (arithmetic mean) of the set of power measurements, a median of the set of power measurements, a geometric mean, a harmonic mean, or other similar representative values.

In some embodiments, method 400 may further include calculating a standard deviation of the first set of power measurements and calculating a standard deviation of the second set of power measurements. In such embodiments, the load type of the load of articles may be determined based on the standard deviation of the first set of power measurements and the standard deviation of the second set of power measurements, such as an NSL score may also or instead be calculated using the standard deviations of the sets of power measurements.

In some embodiments, (460) determining the load type of the load of articles may be further based on a system friction proxy. For example, as described above, the system friction proxy may be calculated from representative values, such as averages and/or standard deviations, of the sets of power measurements.

In some embodiments, the one or more first speeds may be a steady state speed, such that the first set of power measurements may be a first set of dwell power measurements and the second set of power measurements may be a second set of dwell power measurements. In such embodiments, method 400 may further include obtaining a first set of ramp power measurements while accelerating the basket from the steady state speed to the second speed prior to the water extraction operation and obtaining a second set of ramp power measurements while accelerating the basket from the steady state speed to the second speed after obtaining the second set of dwell power measurements. Method 400 may, in such embodiments, also further include calculating an average and a standard deviation of the first set of dwell power measurements, calculating an average and a standard deviation of the second set of dwell power measurements, calculating an average of the first set of ramp power measurements, and calculating an average of the second set of ramp power measurements. In such embodiments, determining the load type of the load of articles may be based on the average and the standard deviation of the first set of dwell power measurements, the average and the standard deviation of the second set of dwell power measurements, the average of the first set of ramp power measurements, and the average of the second set of ramp power measurements. For example, the NSL score may be calculated from the average and the standard deviation of the first set of dwell power measurements, the average and the standard deviation of the second set of dwell power measurements, the average of the first set of ramp power measurements, and the average of the second set of ramp power measurements. For example, a SFP may be calculated from the average and the standard deviation of the first set of dwell power measurements and the average and the standard deviation of the second set of dwell power measurements, and the NSL score may be calculated from the SFP, such as from the SFP, the average of the first set of ramp power measurements, and the average of the second set of ramp power measurements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a wash tub mounted within the washing machine appliance and a basket rotatably mounted within the wash tub, the method comprising:

rotating the basket at one or more first speeds prior to a water extraction operation;

obtaining a first set of power measurements for power drawn by a motor of the washing machine appliance while rotating the basket at the one or more first speeds prior to the water extraction operation;

performing the water extraction operation after obtaining the first set of power measurements, wherein the water extraction operation comprises rotating the basket at a second speed greater than the one or more first speeds;

rotating the basket at the one or more first speeds after the water extraction operation;

obtaining a second set of power measurements for power drawn by the motor of the washing machine appliance while rotating the basket at the one or more first speeds after the water extraction operation; and determining a load type of a load of articles based on the first set of power measurements and the second set of power measurements.

2. The method of claim 1, wherein the one or more first speeds comprises a steady state speed, wherein the first set of power measurements comprises a first set of dwell power measurements and the second set of power measurements comprises a second set of dwell power measurements.

3. The method of claim 2, further comprising obtaining a set of ramp power measurements while accelerating the basket from the steady state speed to the second speed.

4. The method of claim 3, wherein the set of ramp power measurements is a first set of ramp power measurements obtained prior to the water extraction operation, further comprising obtaining a second set of ramp power measurements while accelerating the basket from the steady state speed to the second speed after obtaining the second set of dwell power measurements.

5. The method of claim 1, wherein the one or more first speeds comprises accelerating the basket from a steady state speed to the second speed, wherein the first set of power measurements comprises a first set of ramp power measurements and the second set of power measurements comprises a second set of ramp power measurements.

6. The method of claim 5, further comprising obtaining a set of dwell power measurements while rotating the basket at the steady state speed.

7. The method of claim 6, wherein the set of dwell power measurements is a first set of dwell power measurements obtained prior to obtaining the first set of ramp power measurements, further comprising obtaining a second set of dwell power measurements while rotating the basket at the steady state speed after the water extraction operation and prior to obtaining the second set of ramp power measurements.

8. The method of claim 1, further comprising calculating a representative value of the first set of power measurements and calculating a representative value of the second set of power measurements, wherein the load type of the load of articles is determined based on the representative value of the first set of power measurements and the representative value of the second set of power measurements.

9. The method of claim 1, further comprising calculating a standard deviation of the first set of power measurements and calculating a standard deviation of the second set of power measurements, wherein the load type of the load of articles is determined based on the standard deviation of the first set of power measurements and the standard deviation of the second set of power measurements.

10. The method of claim 1, wherein determining the load type of the load of articles is further based on a system friction proxy.

11. The method of claim 1, wherein the one or more first speeds comprises a steady state speed, wherein the first set of power measurements comprises a first set of dwell power measurements and the second set of power measurements comprises a second set of dwell power measurements, further comprising obtaining a first set of ramp power measurements while accelerating the basket from the steady state speed to the second speed prior to the water extraction operation, obtaining a second set of ramp power measurements while accelerating the basket from the steady state speed to the second speed after obtaining the second set of dwell power measurements, calculating an average and a standard deviation of the first set of dwell power measurements, calculating an average and a standard deviation of the second set of dwell power measurements, calculating an average of the first set of ramp power measurements, and calculating an average of the second set of ramp power measurements, wherein determining the load type of the load of articles is based on the average and the standard deviation of the first set of dwell power measurements, the average and the standard deviation of the second set of dwell power measurements, the average of the first set of ramp power measurements, and the average of the second set of ramp power measurements.

12. A washing machine appliance, comprising:

a wash tub mounted within the washing machine appliance;

a basket rotatably mounted within the wash tub; and a controller, the controller configured for:

rotating the basket at one or more first speeds prior to a water extraction operation;

obtaining a first set of power measurements for power drawn by a motor of the washing machine appliance while rotating the basket at the one or more first speeds prior to the water extraction operation;

performing the water extraction operation after obtaining the first set of power measurements, wherein the water extraction operation comprises rotating the basket at a second speed greater than the one or more first speeds;

rotating the basket at the one or more first speeds after the water extraction operation;

obtaining a second set of power measurements for power drawn by the motor of the washing machine appliance while rotating the basket at the one or more first speeds after the water extraction operation; and determining a load type of a load of articles based on the first set of power measurements and the second set of power measurements.

13. The washing machine appliance of claim 12, wherein the one or more first speeds comprises a steady state speed, wherein the first set of power measurements comprises a first set of dwell power measurements and the second set of power measurements comprises a second set of dwell power measurements.

14. The washing machine appliance of claim 13, wherein the controller is further configured for obtaining a first set of ramp power measurements while accelerating the basket from the steady state speed to the second speed prior to the water extraction operation, and is further configured for obtaining a second set of ramp power measurements while accelerating the basket from the steady state speed to the second speed after obtaining the second set of dwell power measurements.

15. The washing machine appliance of claim 12, wherein the one or more first speeds comprises accelerating the basket from a steady state speed to the second speed, wherein the first set of power measurements comprises a first set of ramp power measurements and the second set of power measurements comprises a second set of ramp power measurements.

16. The washing machine appliance of claim 15, wherein the controller is further configured for obtaining a first set of dwell power measurements while rotating the basket at the steady state speed prior to obtaining the first set of ramp power measurements and is further configured for obtaining a second set of dwell power measurements while rotating the basket at the steady state speed after the water extraction operation and prior to obtaining the second set of ramp power measurements.

17. The washing machine appliance of claim 12, wherein the controller is further configured for calculating a representative value of the first set of power measurements and calculating a representative value of the second set of power measurements, wherein the load type of the load of articles is determined based on the representative value of the first set of power measurements and the representative value of the second set of power measurements.

18. The washing machine appliance of claim 12, wherein the controller is further configured for calculating a standard deviation of the first set of power measurements and calculating a standard deviation of the second set of power measurements, wherein the load type of the load of articles is determined based on the standard deviation of the first set of power measurements and the standard deviation of the second set of power measurements.

19. The washing machine appliance of claim 12, wherein determining the load type of the load of articles is further based on a system friction proxy.

20. The washing machine appliance of claim 12, wherein the one or more first speeds comprises a steady state speed, wherein the first set of power measurements comprises a first set of dwell power measurements and the second set of power measurements comprises a second set of dwell power measurements, wherein the controller is further configured for obtaining a first set of ramp power measurements while accelerating the basket from the steady state speed to the second speed prior to the water extraction operation, obtaining a second set of ramp power measurements while accelerating the basket from the steady state speed to the second speed after obtaining the second set of dwell power measurements, calculating an average and a standard deviation of the first set of dwell power measurements, calculating an average and a standard deviation of the second set of dwell power measurements, calculating an average of the first set of ramp power measurements, and calculating an average of the second set of ramp power measurements, wherein determining the load type of the load of articles is based on the average and the standard deviation of the first set of dwell power measurements, the average and the standard deviation of the second set of dwell power measurements, the average of the first set of ramp power measurements, and the average of the second set of ramp power measurements.

* * * * *